US011091922B2

(12) United States Patent
Kelly et al.

(10) Patent No.: US 11,091,922 B2
(45) Date of Patent: Aug. 17, 2021

(54) COMPOSITE TILT-UP PANEL

(71) Applicants: David L. Kelly, Sacramento, CA (US); Michael J. Recker, Palmetto, FL (US); Darryl Dixon, Riverview, FL (US)

(72) Inventors: David L. Kelly, Sacramento, CA (US); Michael J. Recker, Palmetto, FL (US); Darryl Dixon, Riverview, FL (US)

(73) Assignee: Meadow Burke, LLC, Riverview, FL (US)

( * ) Notice: Subject to any disclaimer, the term of this patent is extended or adjusted under 35 U.S.C. 154(b) by 0 days.

(21) Appl. No.: 16/446,164

(22) Filed: Jun. 19, 2019

(65) Prior Publication Data

US 2019/0383045 A1 Dec. 19, 2019

Related U.S. Application Data

(60) Provisional application No. 62/686,936, filed on Jun. 19, 2018, provisional application No. 62/811,428, filed on Feb. 27, 2019.

(51) Int. Cl.

| | |
|---|---|
| ***F16B 21/09*** | (2006.01) |
| ***E04G 21/14*** | (2006.01) |
| ***E04C 2/288*** | (2006.01) |
| ***E04G 15/04*** | (2006.01) |

(52) U.S. Cl.

CPC ..... *E04G 21/142* (2013.01); *E04C 2/2885* (2013.01); *E04G 15/04* (2013.01)

(58) Field of Classification Search

CPC ..... F16B 21/09; F16B 12/22; F16B 5/0036; F16B 2200/30; E04G 21/142; E04G 15/04; E04C 2/2888

USPC ..... 248/221.12, 220.42, 220.43, 200

See application file for complete search history.

(56) References Cited

U.S. PATENT DOCUMENTS

| | | | | |
|---|---|---|---|---|
| 1,586,833 A | | 6/1926 | Nicholson | |
| 2,358,890 A | * | 9/1944 | Tinnerman | F16B 21/16 411/529 |
| 2,801,895 A | * | 8/1957 | Gass | A47B 88/941 312/257.1 |
| 2,886,370 A | | 5/1959 | Liebert | |
| 3,095,672 A | | 7/1963 | Di Tullio | |
| 3,453,796 A | | 7/1969 | Gutmann | |
| 3,712,014 A | | 1/1973 | Waemer | |
| 4,068,878 A | | 1/1978 | Wilner | |
| 4,869,042 A | | 9/1989 | Fricker | |

(Continued)

FOREIGN PATENT DOCUMENTS

| | | |
|---|---|---|
| WO | WO 2008/078008 | 7/2008 |
| WO | WO 2014/185911 | 11/2014 |

*Primary Examiner* — Brent W Herring
*Assistant Examiner* — Daniel J Kenny
(74) *Attorney, Agent, or Firm* — Sheridan Ross P.C.

(57) ABSTRACT

Composite precast concrete panels are described herein having have an anchor that distributes forces imposed on the anchor through concrete wythes of the panels. Specifically, pins can be embedded in at least one concrete wythe, and then the anchor is secured to the wythe as described herein. The anchor extends through another Wythe to selectively connect to a hoist system that moves and places the composite precast concrete panel. The forces imposed on the anchor are distributed through the pins and into multiple concrete wythes to prevent failure of the composite precast concrete panels and improve safety.

16 Claims, 13 Drawing Sheets

(56) References Cited

U.S. PATENT DOCUMENTS

| | | | | |
|---|---|---|---|---|
| 5,440,845 | A | 8/1995 | Tadros et al. | |
| 5,625,993 | A | 5/1997 | Kelly | |
| 5,857,296 | A | 1/1999 | Niday et al. | |
| 5,924,260 | A | 7/1999 | Austin et al. | |
| 6,088,985 | A | 7/2000 | Clark | |
| 6,092,849 | A | 7/2000 | Zambelli et al. | |
| 6,230,465 | B1 | 5/2001 | Messenger et al. | |
| 6,701,683 | B2 | 3/2004 | Messenger et al. | |
| 6,729,090 | B2 | 5/2004 | Messenger et al. | |
| 6,761,007 | B2 | 7/2004 | Lancelot, III et al. | |
| 6,898,908 | B2 | 5/2005 | Messenger et al. | |
| 7,100,336 | B2 | 9/2006 | Messenger et al. | |
| 7,627,997 | B2 | 12/2009 | Messenger et al. | |
| 7,735,270 | B2 | 6/2010 | Olle et al. | |
| 8,667,746 | B1 | 3/2014 | Francies, III | |
| 8,806,811 | B1 | 8/2014 | Tadros et al. | |
| 8,959,847 | B2 | 2/2015 | Recker et al. | |
| 9,151,065 | B1 | 10/2015 | Francies, III | |
| 9,493,946 | B2 | 11/2016 | Foderberg et al. | |
| 9,803,354 | B1 | 10/2017 | Francies, III | |
| 10,138,917 | B2 * | 11/2018 | Koch | F16B 5/0614 |
| 1,028,778 | A1 | 5/2019 | Tadros et al. | |
| 1,076,737 | A1 | 9/2020 | Seshappa et al. | |
| 2005/0081484 | A1 | 4/2005 | Yland et al. | |
| 2006/0218870 | A1 | 10/2006 | Messenger et al. | |
| 2007/0039281 | A1 | 2/2007 | Zambelli et al. | |
| 2007/0144093 | A1 | 6/2007 | Messenger et al. | |
| 2008/0104913 | A1 | 5/2008 | Messenger et al. | |
| 2008/0276559 | A1 | 11/2008 | Messenger et al. | |
| 2010/0058677 | A1 | 3/2010 | Arteon | |
| 2012/0060435 | A1 | 3/2012 | Heudorfer et al. | |
| 2013/0036678 | A1 | 2/2013 | Nyce et al. | |
| 2014/0318074 | A1 | 10/2014 | Heudorfer et al. | |
| 2015/0007520 | A1 * | 1/2015 | Hohmann, Jr. | E04B 1/4178 52/562 |
| 2018/0306224 | A1 * | 10/2018 | Boone | B65D 19/0077 |
| 2019/0063088 | A1 | 2/2019 | Hansort | |
| 2020/0318341 | A1 * | 10/2020 | Jablonsky | E04B 1/4114 |

* cited by examiner

COMPOSITE TILT-UP PANEL

CROSS-REFERENCE TO RELATED APPLICATIONS

This application claims priority under 35 U.S.C. § 119(e) to U.S. Provisional Patent Application Ser. No. 62/686,936 filed Jun. 19, 2018, and claims priority under 35 U.S.C. § 119(e) to U.S. Provisional Patent Application Ser. No. 62/811,428 filed Feb. 27, 2019, which are incorporated herein in their entireties by reference.

FIELD OF THE INVENTION

Embodiments of the present invention are related to composite precast panels with wythe layers of concrete and an additional layer such as an insulation layer.

BACKGROUND OF THE INVENTION

Precast concrete panels provide advantages in quality control and logistics since precast concrete panels can be fabricated in a controlled environment at a manufacturing facility and assembled into a structure as the panels arrive at a construction site. Moreover, specialized precast concrete panels can improve particular performance characteristics such as thermal performance. For example, composite precast concrete panels may comprise an insulation layer sandwiched between two concrete wythe layers. The concrete wythes provide the necessary structural integrity of the composite panel, and the insulation layer improves the thermal performance of the composite panel.

Anchors can be set in a precast concrete panel to provide an attachment point for a clutch and lifting system that moves the panel into place. Typically, an anchor is secured to a reinforced structure of the concrete panel such as rebar grid. With a composite panel, the anchor is set into one of the concrete wythes. However, this is a potentially unstable configuration as only one portion of the composite panel bears the load imposed on the anchor by the clutch and lifting system.

SUMMARY OF THE INVENTION

The above shortcoming and other needs are addressed by the various embodiments and configurations of the present invention. It is an objective of the present invention to provide a composite panel with an anchor that distributes forces to multiple wythes or concrete layers without compromising the particular characteristics of the panel such as improved thermal performance.

One aspect of embodiments of the present invention is to provide an anchor connected to a plate, and then secure the plate to other layers of the composite panel to distribute forces imposed on the anchor. The plate can generally be disposed between two layers of the panel such as a top concrete wythe and an insulation layer. Then, ties can extend through apertures in the plate, through the insulation, and into another concrete wythe. Thus, when a lifting clutch pulls on the anchor during lifting, the anchor distributes forces to the plate, which in turn distributes forces to a first concrete wythe and through the ties and insulation to a second concrete wythe. When forces are distributed over a larger volume and across multiple layers of the composite panel, it is less likely that the panel will fail, thus improving safety, saving costs by avoiding panel failures, and providing improved safety, etc.

One aspect of embodiments of the present invention is to provide a tie that extends across the insulation layer to a concrete layer to distribute forces but does not compromise the heat transfer performance of the insulation. In some embodiments, the ties can be made from a material such as plastic, polymer, or a composite material which has a higher R-value than steel or concrete. In some embodiments, the ties are made from a material that has a higher R-value than even the insulation. Therefore, the ties do not serve as a thermal bridge but also distribute forces to the second concrete wythe.

One aspect of embodiments of the present invention is to provide a pin that extends from one concrete layer, across an insulation layer, to another concrete layer to distribute forces from a plate and anchor combination to the concrete layers. The pin can be made from a composite material and is designed to be embedded within the concrete layers and increase the pullout capacity of the anchor. In some embodiments, the pin can have one or more recesses configured to receive a portion of one or both of the concrete layers. With concrete embedded in the one or more recesses, the pin is more securely embedded in the concrete layers, particularly along a longitudinal axis of the pin.

Another aspect of embodiments of the present invention is to provide a plate with an aperture and slot combination that allows the plate to selectively lock onto one or more pins. As described herein, one or more pins may be cast in a first wythe and an insulation layer with an exposed end of the at least one pin extending above the insulation layer. The exposed end may have a recess on a side of the pin that narrows a width of the pin to a recess width. The plate may have apertures to receive the pins and have a respective slot that is adjacent to the aperture and forms a continuous opening with the aperture. The slot has a tapering cross-section such that a width of the slot is less than the width of the aperture. In addition, the width of the pin is greater than the slot width, but the recess width of the pin is less than the slot width.

During assembly, the plate can be placed onto the exposed ends of the pins such that the pins first extend through the apertures in a longitudinal direction of the combination. Then, the plate can move laterally relative to the pins such that the exposed ends of the pins slide into the slots. The recesses on the pins and the reduced width of the slots lock the plate to the pins in the longitudinal direction. Plugs can then be placed in the now-empty recesses in the plate to prevent the plate from sliding off of the pins in the lateral direction. A second wythe may be poured onto the combination, and an anchor extending from the plate will pull on both of the plate and pins.

One particular embodiment of the present invention is a composite precast concrete panel, comprising a first concrete wythe having an interior surface and an exterior surface; an insulation layer positioned against the interior surface of the first concrete wythe; a second concrete wythe with an interior surface and an exterior surface, the interior surface of the second concrete wythe positioned against the insulation layer; and a plate positioned between the second concrete wythe and the insulation layer, the plate having a slot with a slot width; and a pin extending through the first concrete wythe, the plate, the insulation layer, and the second concrete wythe, wherein the pin has a pin width that is greater than the slot width, and the pin has a recess with a recess width that is smaller than the slot width, wherein the recess is at least partially positioned in the slot of the plate to secure the plate to the pin and distribute a force from the plate to the pin.

In some embodiments, the panel further comprises an aperture in the plate that forms a continuous opening with the slot, wherein an aperture width of the aperture is greater than the pin width of the pin such that the pin is configured to pass through the aperture in a longitudinal direction. In various embodiments, the panel further comprises a plug at least partially positioned in the aperture to secure the recess of the pin in the slot of the plate. In some embodiments, the panel further comprises a lift anchor extending from the plate into the second concrete wythe; and a void in the second concrete wythe that surrounds at least a portion of the lift anchor, wherein the lift anchor is configured for selective interconnection with a hoist system.

In some embodiments, a thermal conductivity of the pin is less than a thermal conductivity of the first concrete wythe and the second concrete wythe. In various embodiments, the panel further comprises a collar positioned around an outer surface of the pin, the collar having an alignment protrusion extending outwardly from the pin, wherein the alignment protrusion is positioned in an alignment recess in at least one of the insulation layer or the second concrete wythe. In some embodiments, the pin has a second recess at least partially positioned in the second concrete wythe.

Another particular embodiment of the present invention is a method of forming a composite precast concrete panel, comprising (i) providing a form with outer edges that define a perimeter shape of said composite precast concrete panel; (ii) pouring concrete into a form that defines a first wythe; (iii) positioning an insulation layer on the first wythe; (iv) extending at least one pin through the insulation layer and into the first wythe, wherein the at least one pin has a pin width and an exposed end of the at least one pin has a recess with a recess width, wherein the recess width is smaller than the pin width; (v) positioning a plate on the insulation layer such that the pin extends through an aperture of the plate, wherein the plate has a slot positioned adjacent to the aperture, and the slot and the aperture form a continuous opening, and wherein the pin width is larger than the slot width, and the recess width is smaller than the slot width; (vi) moving the plate so that the recess of the at least one pin is at least partially positioned in the slot to secure the plate to the at least one pin; and (vii) pouring concrete into a form that defines a second wythe on top of the plate and the insulation layer.

In various embodiments, the method further comprises (viii) screeding concrete poured into the form that defines the first wythe and screeding concrete poured into the form that defines the second wythe. In some embodiments, the at least one pin comprises a second recess on a portion of the at least one pin that extends into said first wythe. In some embodiments, at least one reinforcing structure is placed in the form that defines the first wythe prior to the pouring of concrete into the form. In various embodiments, the at least one pin is comprised of a material with a thermal conductivity less than a thermal conductivity of the first and second concrete wythes. In some embodiments, the method further comprises (ix) positioning a void former around a lift anchor extending from the plate, wherein the void former defines a void in the second concrete wythe that provides access to the lift anchor.

A further particular embodiment of the present invention is an apparatus for selectively securing a plate to a pin, comprising a plate having a substantially planar shape; an aperture extending through the plate, the aperture having an aperture width; a slot extending through the plate, the slot having a slot width that is smaller than the aperture width, wherein the slot and the aperture combine to form a continuous opening; a pin having a pin width that is greater than the slot width, wherein a recess in the pin defines a recess width that is smaller than the slot width; wherein, in a first position, the pin is adapted to pass through the aperture in the plate in a longitudinal direction; and wherein, in a second position, the pin is adapted to move into the slot in the plate in a lateral direction such that the recess of the pin is at least partially positioned in the slot of the plate to secure the plate to the pin and distribute a force from the plate to the pin.

In some embodiments, the apparatus further comprises a lift anchor extending from a top surface of the plate. In various embodiments, the slot tapers from a top width at a top surface of the plate to the slot width at a bottom surface of the plate. In some embodiments, the apparatus further comprises a plug adapted for positioning in the aperture to secure the pin in the slot of the plate. In various embodiments, the apparatus further comprises a collar positioned about the pin, wherein the collar has an outer dimension greater than the aperture width, and the collar allows the pin to pass through the aperture in the plate to a predetermined distance in the first position. In some embodiments, an alignment projection extends from the collar to align the pin in a predetermined direction relative to the plate.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1A:
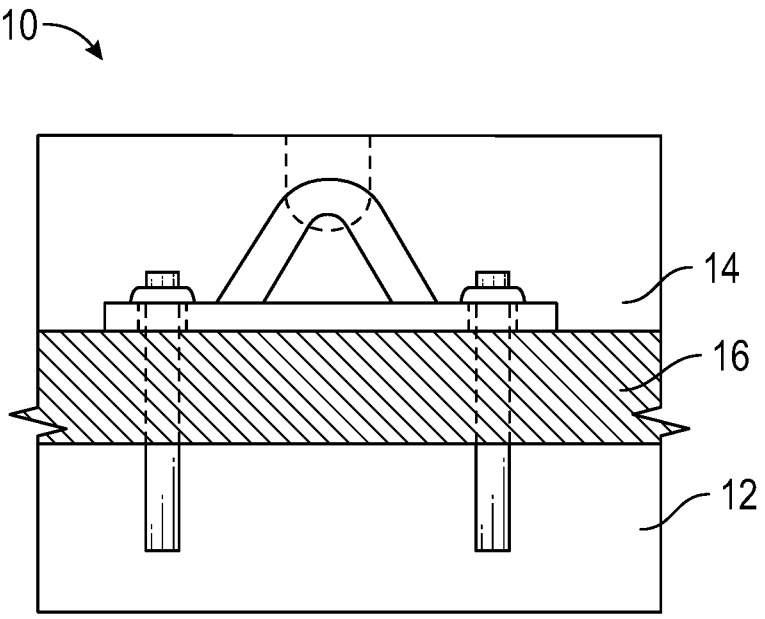
FIG. 1A is a cross-sectional front elevation view of a composite panel in accordance with one embodiment of the present invention.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Panel |
| 12 | Bottom Concrete Wythe |
| 14 | Top Concrete Wythe |
| 16 | Insulation |
| 18 | Anchor |
| 20 | Void |
| 22 | Plate |
| 24 | Tie |
| 26 | Shear Cone |
| 28 | Top Wythe Thickness |
| 30 | Insulation Thickness |
| 32 | Bottom Wythe Thickness |
| 34 | Plate Width |
| 36 | Plate Length |
| 38 | Pin |
| 40 | Collar/Grip |
| 42a, 42b | Recess |
| 44 | Pin Height |
| 46 | Pin Width |
| 48 | Aperture |
| 50 | Rib |
| 52 | Void Former |
| 54 | Plug |
| 56 | Alignment Protrusion |
| 58 | Alignment Recess |
| 60 | Insulation Aperture |
| 62 | Slot |
| 64 | Slot Taper |
| 66 | Plate Offset |
| 68 | Anchor Height |
| 70 | First Slot Horizontal Offset |
| 72 | Slot-to-Slot Offset |
| 74 | Second Slot Horizontal Offset |
| 76 | Plate Length |
| 78 | First Aperture Horizontal Offset |
| 80 | Aperture-to-Aperture Horizontal Offset |
| 82 | Second Aperture Horizontal Offset |
| 84 | Plate Width |
| 86 | First Slot/Aperture Vertical Offset |
| 88 | First Slot/Aperture Length |

-continued

| Number | Component |
|---|---|
| 90 | Slot/Aperture-to-Slot/Aperture Offset |
| 92 | Second Slot/Aperture Length |
| 94 | Second Slot/Aperture Vertical Offset |
| 96 | Aperture Width |
| 98 | Top Slot Width |
| 100 | Bottom Slot Width |
| 102 | Slot/Aperture Length |
| 104 | First Slot Radius |
| 106 | Second Slot Radius |
| 108 | First Length |
| 110 | Second Length |
| 112 | Third Length |
| 114 | Fourth Length |
| 116 | Aperture Radius |
| 118 | Fifth Length |
| 120 | Sixth Length |
| 122 | Seventh Length |
| 124 | Eighth Length |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict panels, anchors, plates, and ties, and methods and systems for using the same, the present invention is not limited to these embodiments. It will be further understood that the terms "collar" and "grip" can be used interchangeably.

Figure 1B:
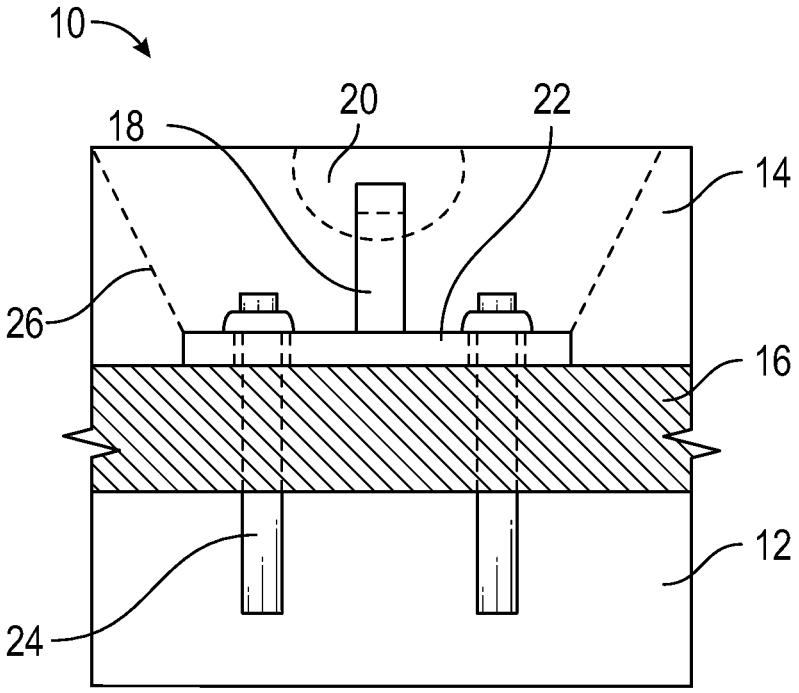
FIG. 1B is another cross-sectional elevation view of the composite panel in FIG. 1A in accordance with one embodiment of the present invention.
Figure 1C:
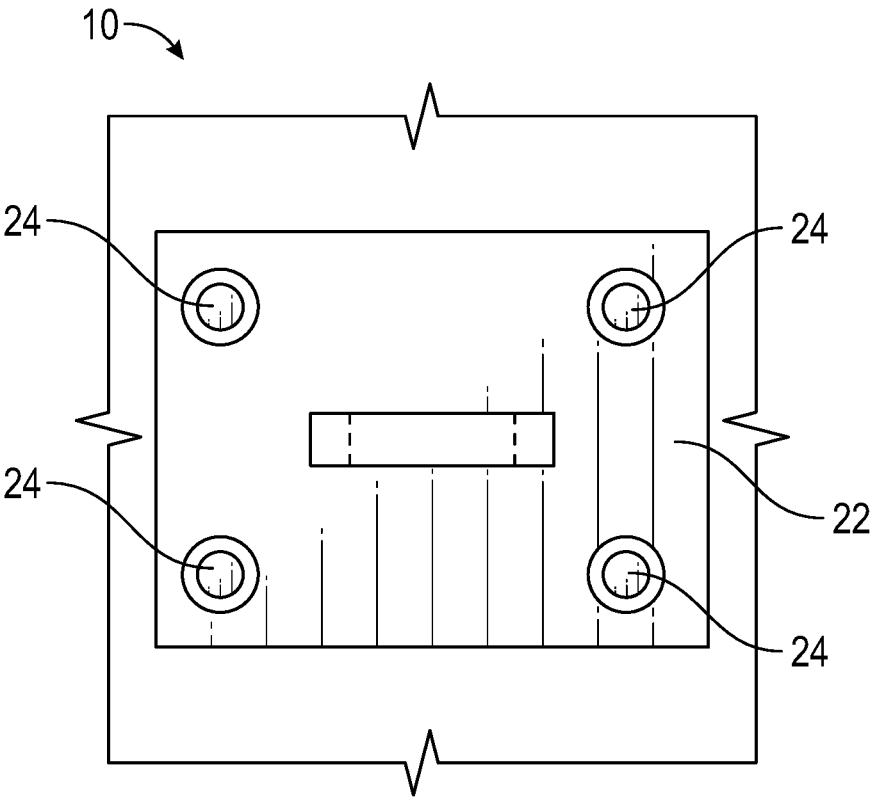
FIG. 1C is a top plan view of the composite panel in FIG. 1A in accordance with one embodiment of the present invention.

Referring now to FIGS. 1A-1C, various views of a composite panel 10 are provided. Specifically, FIG. 1A is a cross-sectional elevation view, FIG. 1B is a further cross-sectional elevation view, and FIG. 1C is a top plan view. As shown in FIG. 1A, the composite panel 10 generally comprises a bottom concrete wythe 12, a top concrete wythe 14, and an insulation layer 16 positioned between the concrete wythes 12, 14. It will be appreciated that the concrete wythes 12, 14 and the insulation 16 can be comprised of many different materials or combinations of materials. For example, concrete wythes 12, 14 can be made from any variety of concrete or cement, and the insulation 16 can be made from a one or two component polyurethane foam, a closed-cell extruded polystyrene foam, fiber glass, etc. Alternatively, the order and positioning of the various layers of concrete and insulation material can be modified and selectively changed based on the application of the panel.

Referring now to FIG. 1B, a further side, cross-sectional view of the composite panel 10 is provided. An anchor 18 is positioned in the top concrete wythe 14, and a void 20 exposes at least a portion of the anchor 18 to the exterior of the panel 10. Therefore, a clutch and lifting system can selectively connect to the exposed portion of the anchor 18 to maneuver the panel 10 in place. To create the anchor 18 and void 20 combination, the anchor 18 is placed in a predetermined position. Next, a void former is placed around at least a portion of the anchor 18 to prevent any concrete from reaching this portion of the anchor 18 and to create the void 20. Then, concrete is poured to create the top concrete wythe 14, and the anchor 18 will have at least some portion encased in the concrete of the top concrete wythe 14 and at least another portion exposed to selectively connect to the clutch and lifting system.

In the depicted embodiment, the anchor 18 is connected to a plate 22, which lies against a surface of the insulation 16. One or more ties 24 extend through the plate 22, through the insulation 16, and into the bottom concrete wythe 12. In this configuration, an anchor 18 that is selectively connected to a clutch and lifting system can distribute forces among the plate 22, the insulation 16, and the bottom concrete wythe 12. The plate 22 also increases the lateral surface area in the top concrete wythe 14 that the anchor 18 distributes forces to when the anchor 18 is engaged by the clutch and lifting system. A shear cone 26 is the portion of concrete around the anchor 18 that can fail due to the inability of the concrete to contain the stresses of the load imposed on the anchor 18. Generally, the shear cone 26 starts at the ends of the anchor 18, or in this embodiment the plate 22, and expands toward the surface of the panel 10. Generally, a larger and more substantial shear cone 26 is less likely to fail.

In some embodiments, a first insert can be positioned in the bottom concrete wythe 12 that extends to the lower surface of the insulation 16, which permits screeding of the bottom concrete wythe 12 during manufacture of the composite panel. Then, a second insert extends through the top concrete wythe 14, through the insulation 16, and into the first insert. The second insert can be connected to a third insert in the top concrete wythe 14 such that when a clutch and lifting system selectively connects to the third insert, forces imposed on the third insert are distributed through the first and second inserts and into the concrete wythes 12, 14. It will be appreciated that the inserts can be made from any materials including plastic, steel, etc.

Referring now to FIG. 1C, a top plan view of the plate 22 is provided. In this embodiment, the plate 22 has four apertures through which ties 24 can be inserted through the plate 22, through the insulation 16, and into the bottom concrete wythe 12. It will be appreciated that there can be fewer or more than four apertures and ties 24. In addition, the ties 24 each have a collar with an outer diameter that is larger than the inner diameter of the aperture in the plate 22. The collar sets the tie 24 at a predetermined position in the panel 10 when the collar contacts the plate 22, and the collar limits further travel of the tie 24 into the bottom concrete wythe 12. It will be appreciated that this positioning and limiting function of the tie 24 can be accomplished by a bend in the proximal end of the tie 24, by an adjustable nut along a threaded outer surface of the tie 24, etc. In addition, the ties 24 can be substantially vertical in the embodiment show in FIG. 1B, but in other embodiments, one or more ties 24 can form an angle with an axis of the panel 10 such that distal ends of the ties 24 are angled inward or outward to better transfer loads to the bottom concrete wythe 12.

Further still, embodiments of the present invention can enhance thermal properties of the panel 10 and the insulation 16. The ties 24 can be made from one or more materials that have an R-value that is greater than concrete or steel and less than, equal to, or even greater than the R-value of the insulation 16 to prevent a thermal bridge between the concrete wythes 12, 14 that inhibits or diminishes the thermal performance of the insulation 16. In some embodiments, the ties can be made from a material such as plastic, polymer, or a composite material which has a higher R-value than steel or concrete.

R value is related to the thermal conductivity of a material where R=L/λ, R=R value, L=thickness of material, and λ is thermal conductivity. The thermal conductivity of ties and/or pins described herein can be less than approximately $$15\frac{W}{m \cdot K}.$$

In some embodiments, the thermal conductivity of ties and/or pins described herein can be less than approximately $$5\frac{W}{m \cdot K}.$$

It will be appreciated that a variety of anchors 18 can be used in embodiments of the present invention. For example, a variant of the MeadowBurke Super-Lift III can be connected to a plate 22 to provide the anchor and plate combination. Further still, a plurality of anchors 18 can be connected to a single plate 22 to distribute forces across multiple anchors and reduce the likelihood that a connection between the anchor 18 and the plate 22 will fail. It will also be appreciated that the plate 22 itself can be made from variety of materials in a variety of shapes. For instance, the plate 22 can be made of steel or a more thermally insulating material. Further yet, the plate 22 can be shaped, such as a cylindrical shape, to reduce the surface area-to-volume ratio to reduce the heat transfer rate through the plate 22. Alternatively, the plate 22 can be shaped to maximize surface area to more evenly distribute heat transfer between the top concrete wythe 14 and the bottom concrete wythe 12. A second plate 22 can be positioned in the bottom concrete wythe 12 such that the plates 22 are positioned on both sides of the insulation 16. This can provide an even stronger connection between the anchor 18, plates 22, and layers 12, 14, 16 to distribute forces imposed on the anchor 18.

To make the panel 10, the bottom concrete wythe 12, or outer concrete wythe in some embodiments, is formed first. Reinforcing structures are placed substantially within a form that defines the bottom concrete wythe 12. Then, concrete is poured into the form and screed. Prior to the concrete in the bottom concrete wythe 12 setting, an insulation layer 16 is placed on a top surface of the bottom concrete wythe 12. A plate 22, as described herein, can be placed on the insulation later 16. Next, ties 24 are poked through the insulation 16 and into the concrete in the bottom concrete wythe 12, and ties 24 are also positioned through the plate 22, through the insulation 16, and into the bottom concrete wythe 12 as described herein.

Reinforcing structures are placed substantially within a form that defines the upper concrete wythe 14, or inner concrete wythe in some embodiments. The reinforcing structures, such as ties and/or rebar, can locate the anchor 18 in a predetermined position within the upper concrete wythe 14. At this point, a void former can also be connected to the anchor 18 to form a void in the upper concrete wythe 14 around at least a portion of the anchor 18. Then, concrete is poured into the form that defines the upper concrete wythe 14, and the concrete is screed. When the concrete wythes 12, 14 have cured, a clutch and lifting system can selectively connect to the anchor 18 to move the panel 10.

Figure 2A:
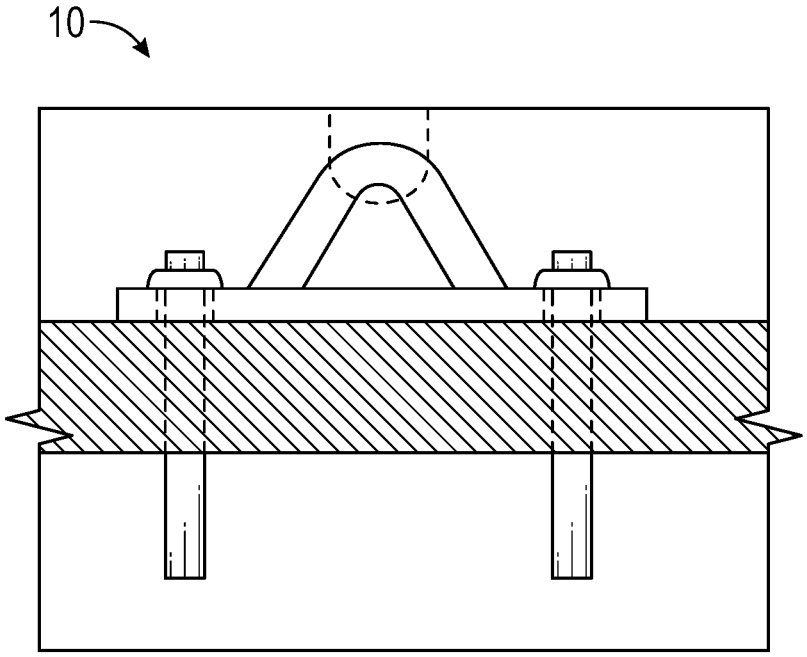
FIG. 2A is a cross-sectional elevation view of a composite panel in accordance with one embodiment of the present invention.
Figure 2B:
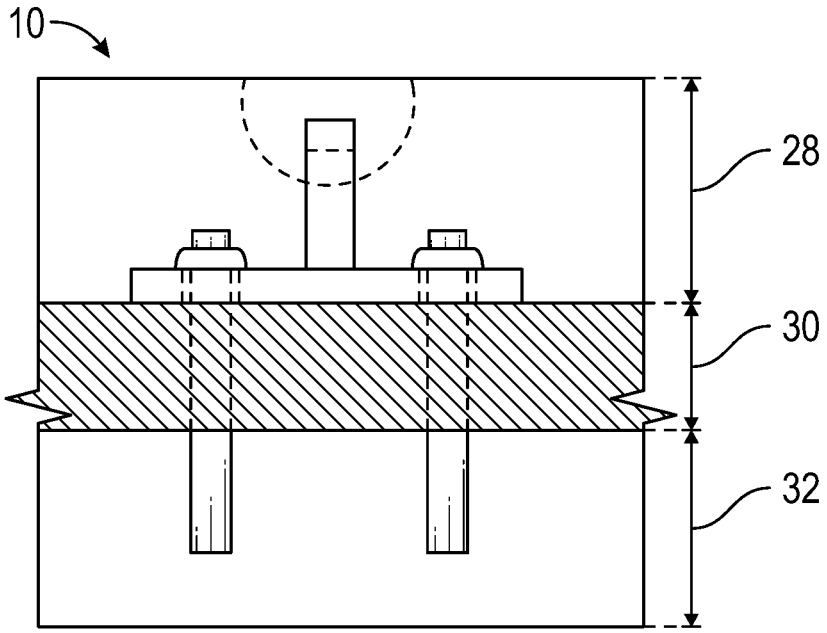
FIG. 2B is a further cross-sectional elevation view of the composite panel in FIG. 2A in accordance with one embodiment of the present invention.
Figure 2C:
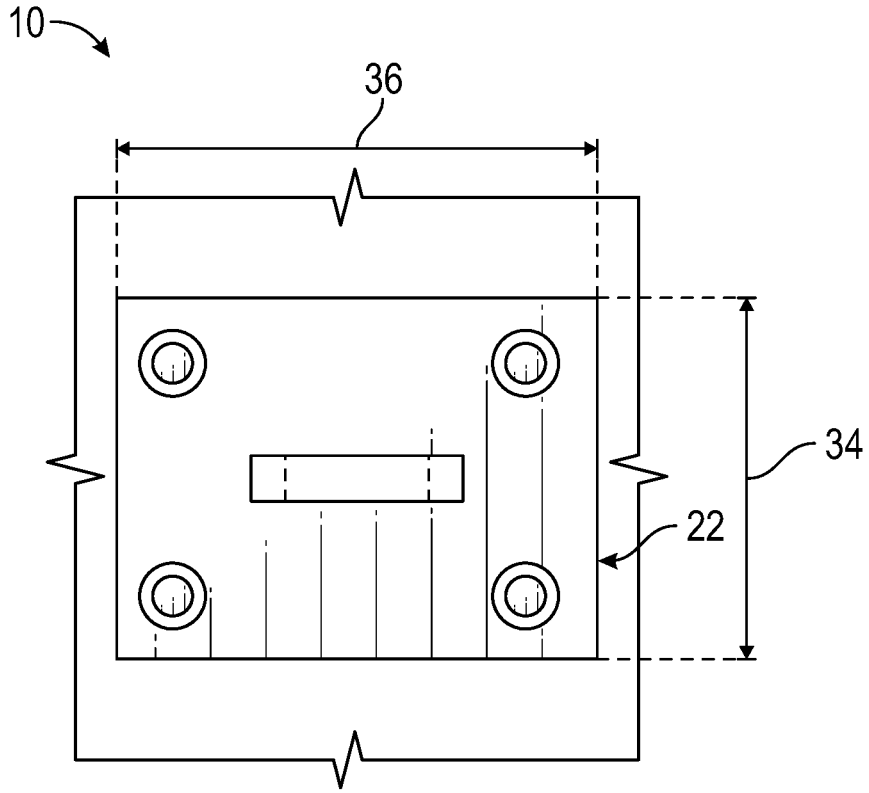
FIG. 2C is a top plan view of the composite panel in FIG. 2A in accordance with one embodiment of the present invention.

Referring now to FIGS. 2A-2C various views of the panel 10 are provided with exemplary dimensions. The top concrete wythe thickness 28 in some embodiments is between approximately 1-12". In various embodiments, the top concrete wythe thickness 28 is between approximately 2-5". In a preferred embodiment, the top concrete wythe thickness 28 is approximately 3". The insulation thickness 30 in some embodiments is between approximately 1-10". In various embodiments, the insulation thickness 30 is between approximately 1.5-4". In a preferred embodiment, the insulation thickness 30 is approximately 2". The bottom concrete wythe thickness 32 is some embodiments is between approximately 1-12". In various embodiments, the bottom concrete wythe thickness 32 is between approximately 2-5". In a preferred embodiment, the bottom concrete wythe thickness 32 is approximately 3".

The plate width 34 in some embodiments is between approximately 2-24". In various embodiments, the plate width 34 is between approximately 4-12". In a preferred embodiment, the plate width 34 is approximately 6". The plate length 36 in some embodiments is between approximately 2-36". In various embodiments, the plate length 36 is between approximately 4-18". In a preferred embodiment, the plate length 36 is approximately 8". The plate thickness in some embodiments is between approximately 1/16-3". In various embodiments, the plate thickness is between approximately ½-1". In a preferred embodiment, the plate thickness is approximately 9/16". In yet another embodiment, the plate dimensions are 10"×10"×½".

Figure 3A:
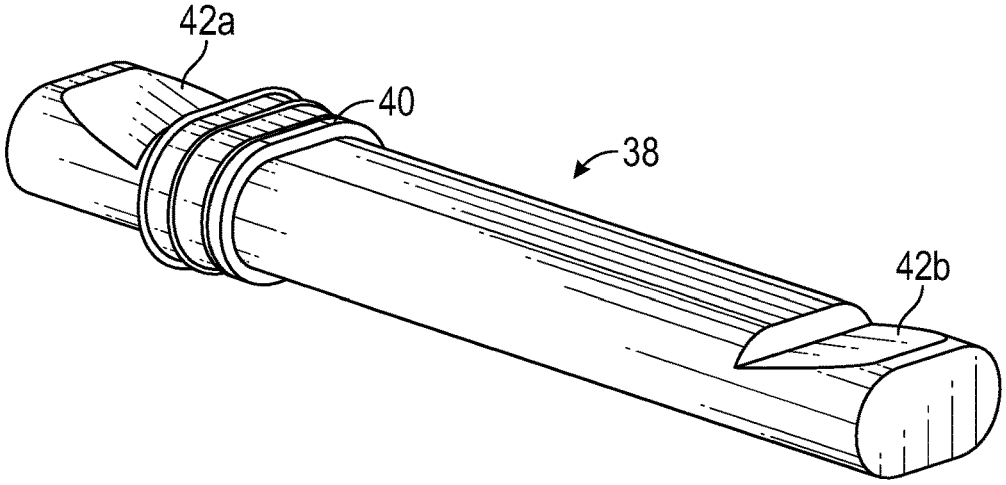
FIG. 3A is a perspective view of a pin in accordance with one embodiment of the present invention.
Figure 3B:
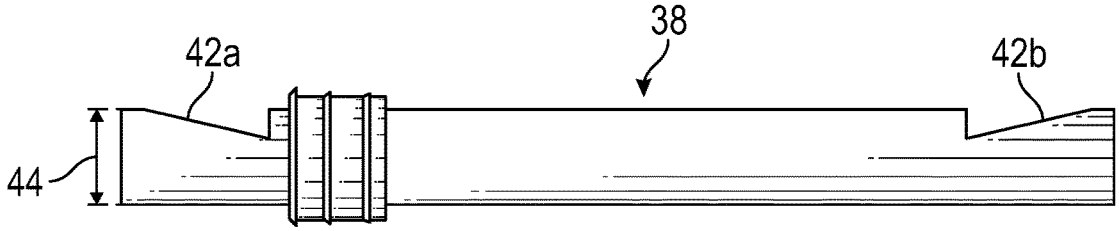
FIG. 3B is a front elevation view of the pin in FIG. 3A in accordance with one embodiment of the present invention.
Figure 3C:
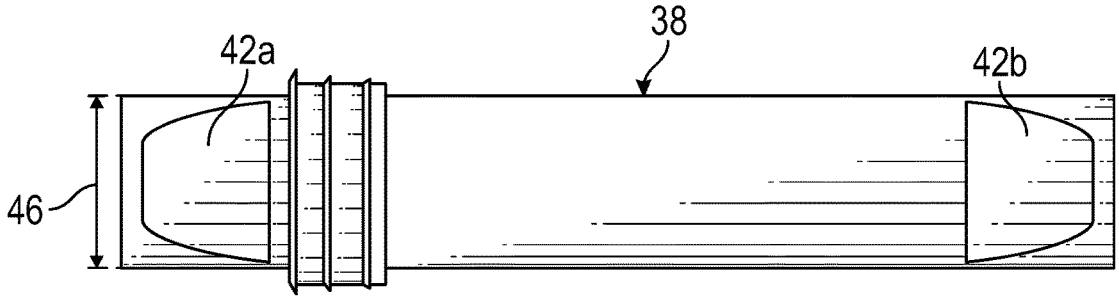
FIG. 3C is a top plan view of the pin in FIG. 3A in accordance with one embodiment of the present invention.
Figure 3D:
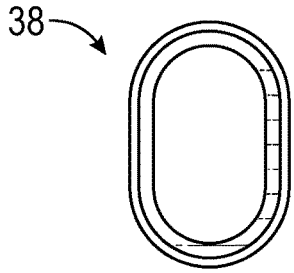
FIG. 3D is a side elevation view of the pin in FIG. 3A in accordance with one embodiment of the present invention.

Now referring to FIGS. 3A-3D, a perspective view of a pin 38 with a collar or grip 40 is provided in FIG. 3A, a front elevation view of the pin 38 is provided in FIG. 3B, a top plan view of the pin 38 is provided in FIG. 3C, and a side elevation view of the pin 38 is provided in FIG. 3D. The pin 38 is configured to be inserted through a plate and anchor combination and extend from a concrete layer, through an insulation layer, and into another concrete layer. The pin 38 distributes forces from the plate and anchor combination to the concrete layers while inhibiting heat transfer between the concrete layers. The pin 38 can be made from a composite material to reduce or inhibit heat transfer.

As shown in FIGS. 3A-3D, the pin 38 has a generally elongated body extending between a first end and a second end. One recess 42*a* is positioned proximate to the first end, and another recess 42*b* is positioned proximate to the second end. When concrete is poured to form the two concrete layers, a portion of one concrete layer enters and cures within the first recess, and a portion of another concrete layer enters and cures within the second recess. This provides a more secure connection between the pin 38 and the concrete layers. Specifically referring to FIG. 3B, concrete within these recesses 42*a*, 42*b* prevents movement or dislodgement of the pin 38 along a longitudinal axis of the pin 38, i.e., from left to right in FIG. 3B.

Further referring to FIG. 3B, each recess 42*a*, 42*b* is defined by a first surface that slopes from an outer portion of the pin 38 and a second surface that forms a right angle with an outer surface of the pin 38. Thus, the recesses 42*a*, 42*b* have an opposing orientation to resist movement relative to a concrete layer once the recesses 42*a*, 42*b* are filled with cement or concrete. It will be appreciated that the recesses 42*a*, 42*b* can have a variety of shapes. For example, more surfaces can define a recess 42*a*, 42*b* where a first surface and a second surface each form a right angle with the outer surface of the pin 38, and then a third surface forms a right angle with both of the first and second surfaces. Further still, a single continuous surface can define a recess 42*a*, 42*b*.

Referring to FIGS. 3B and 3C, a pin height 44 and a pin width 46 are provided. In this embodiment, the pin height 44 is less than the pin width 46 to increase the volume of concrete received in the recesses 42*a*, 42*b*. However, it will be appreciated that the pin height 44 can be equal to or greater than the pin width 46 in various embodiments.

Next, an optional collar or grip 40 for the pin 38 is provided. The grip 40 as shown in FIGS. 3A-3D circumscribes an outer surface of the pin 38 and extends along a longitudinal length of the pin 38. The grip 40 is typically made from a flexible or resilient material, and the grip 40 secures the pin 38 to a plate and anchor combination so that the pin 38 can receive forces from the plate and anchor combination.

Figure 4:
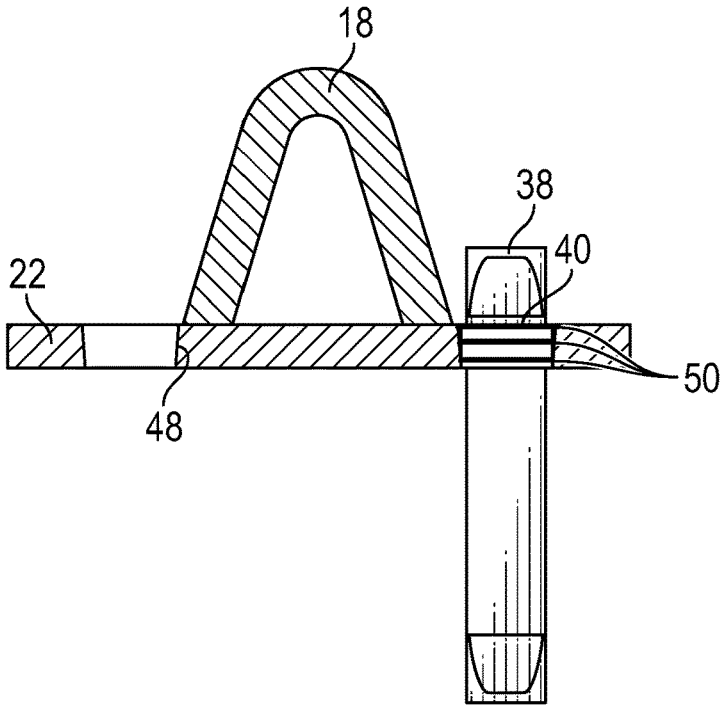
FIG. 4 is a partial cross sectional view of a pin positioned in an aperture of a plate in accordance with one embodiment of the present invention.

Now referring to FIG. 4, a partial cross sectional view of a plate 22 and anchor 18 combination is provided where a pin 38 is inserted through an aperture 48 in the plate 22. The aperture 48 in this embodiment tapers from an upper surface of the plate 22 to a lower surface. In some embodiments, the aperture 48 tapers between approximately 1 and 15 degrees from a vertical plane. In various embodiments, the aperture 48 tapers approximately 5 degrees from a vertical plane. As the pin 38 is inserted through the aperture 48, the resilient grip 40 compresses and binds the pin 38 to the plate 22. In addition, the grip 40 can have one or more ribs 50 positioned on an outer surface of the grip 40. As the grip 40 extends into the aperture 48, the ribs 50 can extend to contact a wider diameter portion of the tapered aperture 48 and/or the ribs 50 can deflect when contacting a smaller diameter portion of the tapered aperture 48 to help bind the pin 38 to the plate 22. As shown in FIG. 4, the grip 40 has three ribs 50 circumscribing an outer surface of the grip 40. It will be appreciated that a rib 50 can partially circumscribe the outer surface of the grip 40, a rib 50 can have a different shape such as a circular protrusion from the outer surface of the grip 40, and the grip 40 can have more or fewer ribs 50 than three, including no ribs 50.

Figure 5:
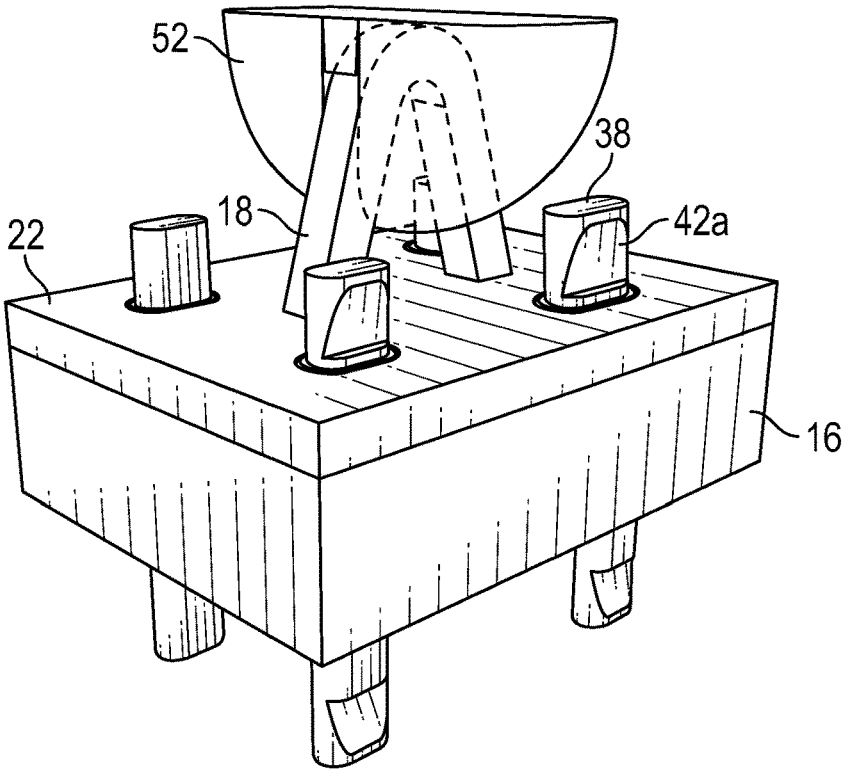
FIG. 5 is a perspective view of a composite tilt-up panel including four pins in accordance with one embodiment of the present invention.

Now referring to FIG. 5, a perspective view of a plate 22 and anchor 18 combination with four pins 38 and a void former 52 is provided. In this embodiment, the plate 22 is positioned adjacent an insulation layer 16, and four pins 38 are inserted through four apertures in the plate 22 such that the pins 38 extend through the insulation layer. In this embodiment, the recesses 42 are outwardly facing. However, it will be appreciated that the recesses 42 can be inwardly facing or oriented at any position about a longitudinal axis of the pin 38. It will further be appreciated that the pin 38 can have more or fewer recesses 24 than two positioned at various locations on the pin 38.

Figure 6:
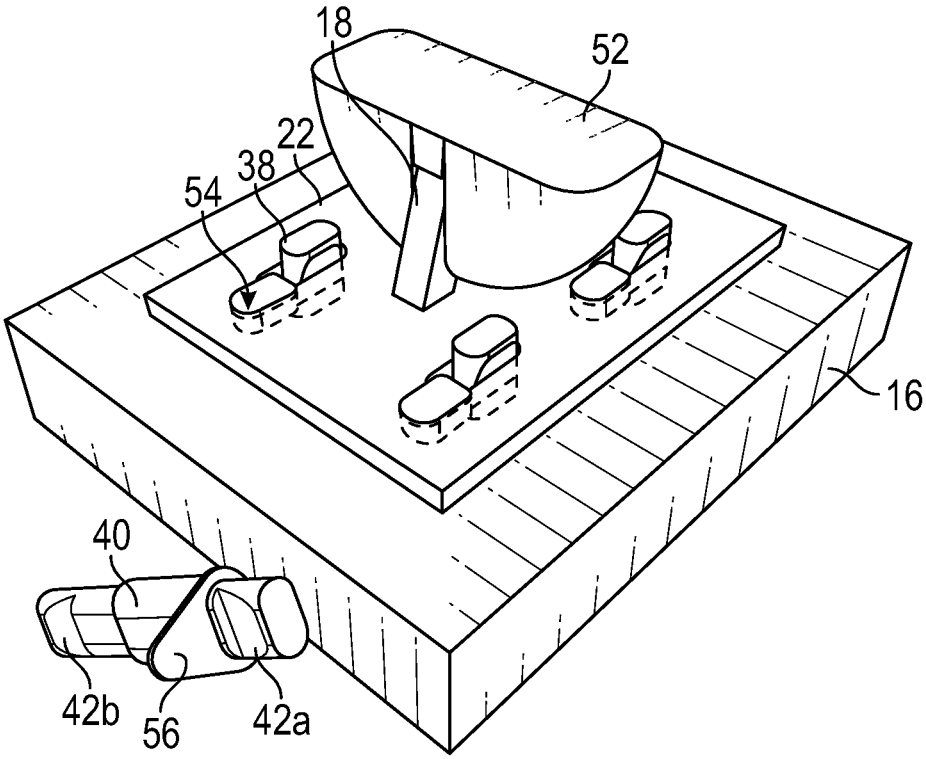
FIG. 6 is a perspective view of a further embodiment of an anchor and plate in accordance with one embodiment of the present invention.
Figure 7:
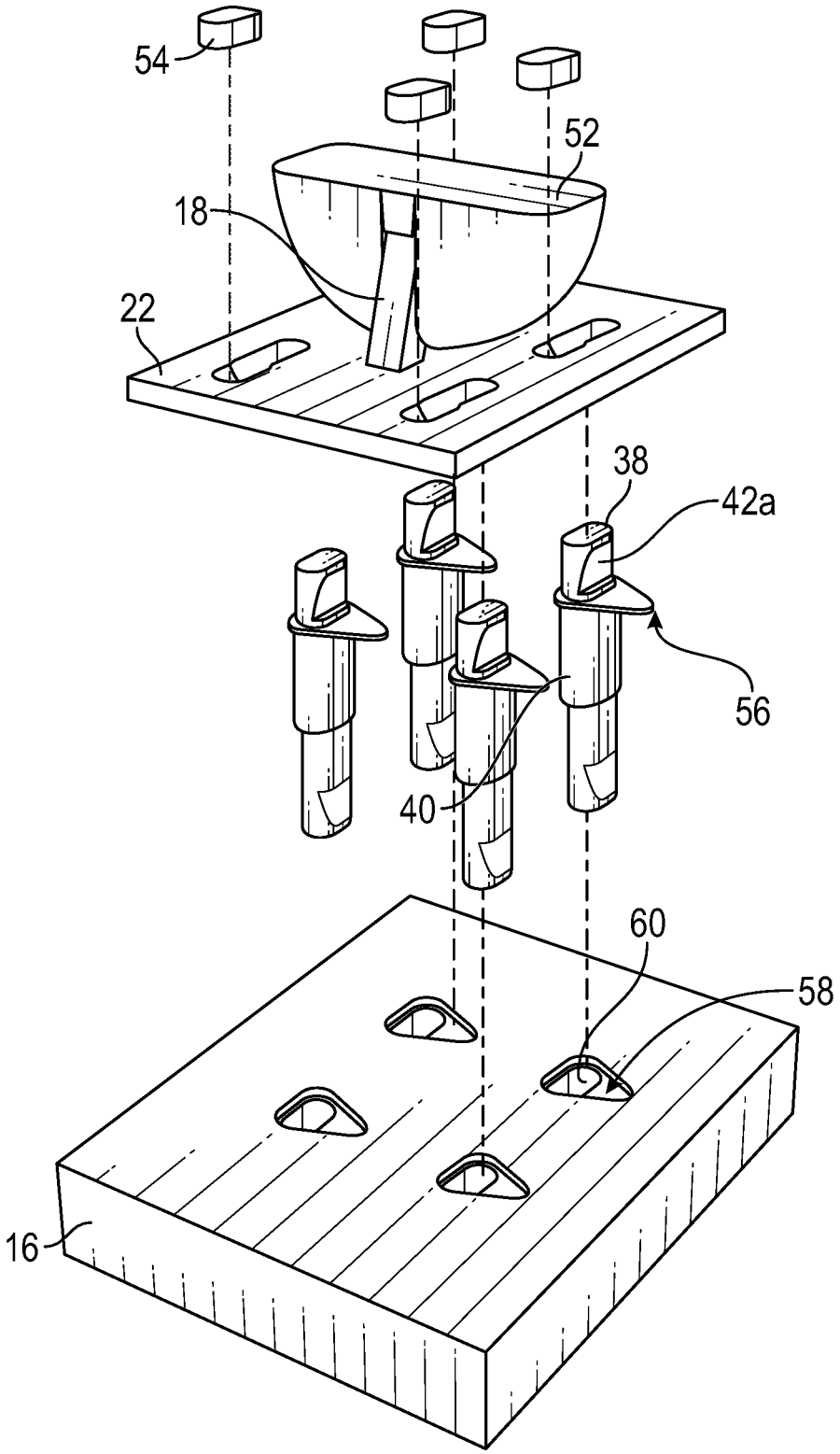
FIG. 7 is an exploded view of the anchor and plate in FIG. 6 in accordance with one embodiment of the present invention.

Referring now to FIGS. 6 and 7, a perspective view and an exploded view, respectively, of a plate 22 and anchor 18 assembly are provided. In this embodiment, four pins 38 are embedded in an insulation layer 16 of the composite precast concrete panel. Each pin 38 has a two ends with a recess 42 positioned at each end. Each pin 38 also has a collar 40 positioned between each recess 42, and the collar 40 has an alignment projection 56 extending in a lateral direction from the pin 38. The alignment projection 56 corresponds to an alignment recess 58 in an insulation layer 16 where the alignment recess 58 is adjacent to an aperture 60 in the insulation layer 16. During assembly, the alignment recess 58 receives the alignment projection 56 to orient the pins 38 in a predetermined direction. Though the depicted pins 38 are aligned in one direction, it will be appreciated that the pins 38 may be oriented in various directions or combinations of directions.

Once the pins 38 are properly aligned and in place, the plate 22 may be positioned on the pins 38. Apertures of the plate 22 are first positioned over the exposed ends of the pins 38. Then, the plate 22 is moved laterally to a second position such that the exposed ends of the pins 38 are positioned in slots that secure onto the recesses 42 of the pins 38. Plugs 54 may now be positioned in the apertures of the plate 22 to secure the pins 38 and the plate 22 together as shown in FIG. 6. Also shown in FIGS. 6 and 7 are an anchor 18 extending upwards from the plate 22 and a void former 52 positioned around at least a portion of the anchor 18 to define a void around the anchor 18. The void excludes material such as concrete from a second wythe during fabrication and allows a hoist system to selectively connect with the anchor and move and orient the composite precast concrete panel to a predetermined location or position.

Figure 8A:
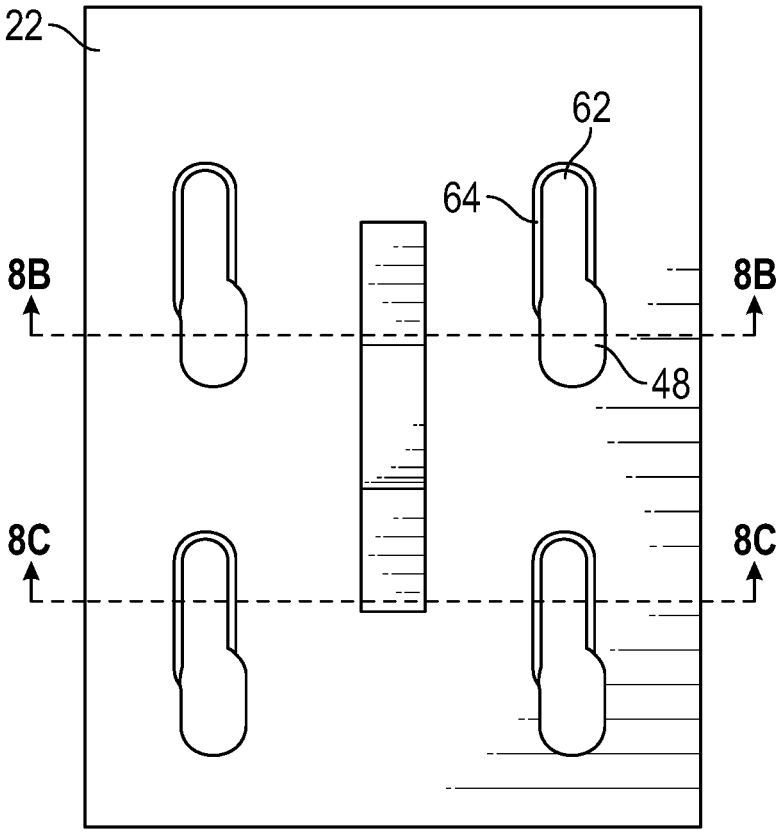
FIG. 8A is a top plan view of a plate in accordance with one embodiment of the present invention.
Figure 8B:
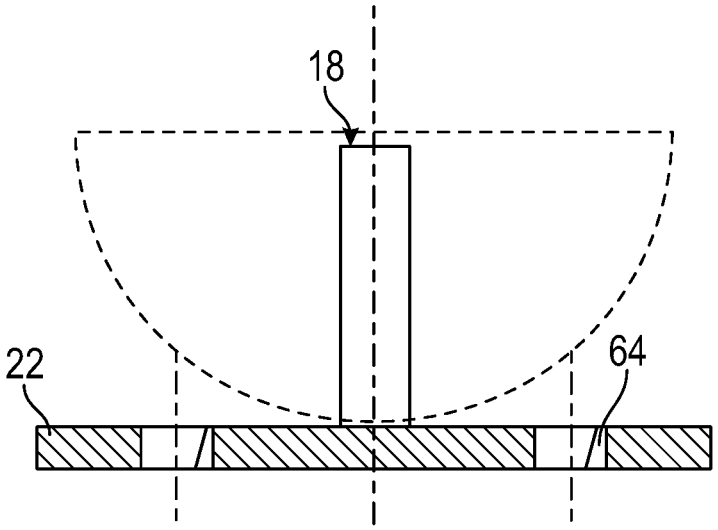
FIG. 8B is a cross-sectional view of the plate in FIG. 8A taken along line B-B in accordance with one embodiment of the present invention.
Figure 8C:
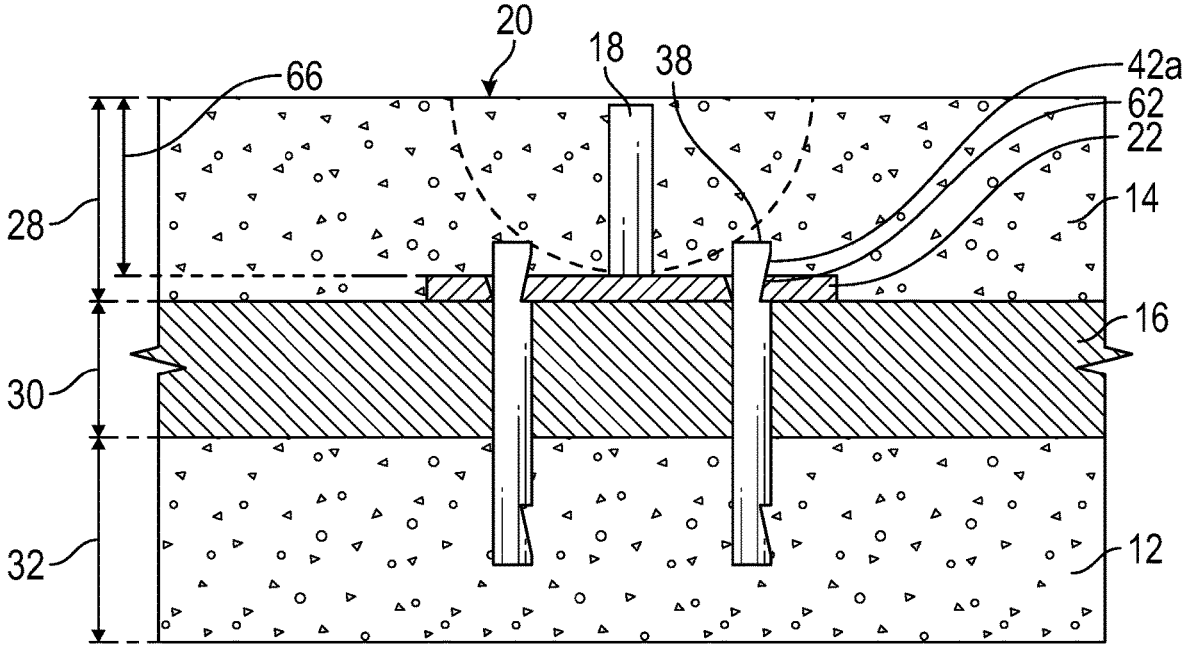
FIG. 8C is a cross-sectional view of the plate in FIG. 8A taken along line C-C in accordance with one embodiment of the present invention.

FIGS. 8A-8C show various views of the aperture 48 and the slot 62 of the plate 22. FIG. 8A is a top plan view of the plate 22, and a slot 62 is positioned adjacent to an aperture 48 such that the slot 62 and aperture 48 form a continuous opening. As the aperture 48 transitions laterally into the slot 62, the width of the slot 62 is less than the width of the aperture 48. In addition, a tapering edge 64 of the slot reduces the width of the slot 62 from a top side of the plate 22 to a bottom side. The tapering edge 64 may taper between approximately 5 and 25 degrees in some embodiments. In various embodiments, the tapering edge may taper at approximately 12 degrees. The tapering edge 64 and reduced width engage the recess of a pin such that the plate 22 is secured onto the pin. Also shown in FIG. 8A are lines B-B and C-C.

Now referring to FIGS. 8B and 8C, cross-sectional views of the plate 22 and anchor 18 taken along lines B-B and C-C, respectively, of FIG. 8A are provided. As shown in FIG. 8B, the anchor 18 extends upward from the plate 22, and the tapering edge 64 of the slot reduces the width of the slot. As described elsewhere herein, the plate 22 may have varying thicknesses, including ⅜". As shown in FIG. 8C, the top wythe 14, the insulation layer 16, and the bottom wythe 12 have varying thicknesses 28, 30, 32 as described elsewhere herein. The slot 62 of the plate 22 tapers inward to secure onto the recess 42 of the pin 38. Therefore, when a clutch engages the anchor 18 and pulls the anchor 18, the plate 22 and the pins 38 are secured together such that the anchor 18 pulls on multiple layers 28, 30, 32 of the composite precast concrete panel. In some embodiments, a plate offset 66 from the top surface of the plate 22 to an outer surface of the top wythe 14 may be between approximately 1" and 4". In various embodiments, the plate offset 66 is approximately 2⅝".

Figure 9A:
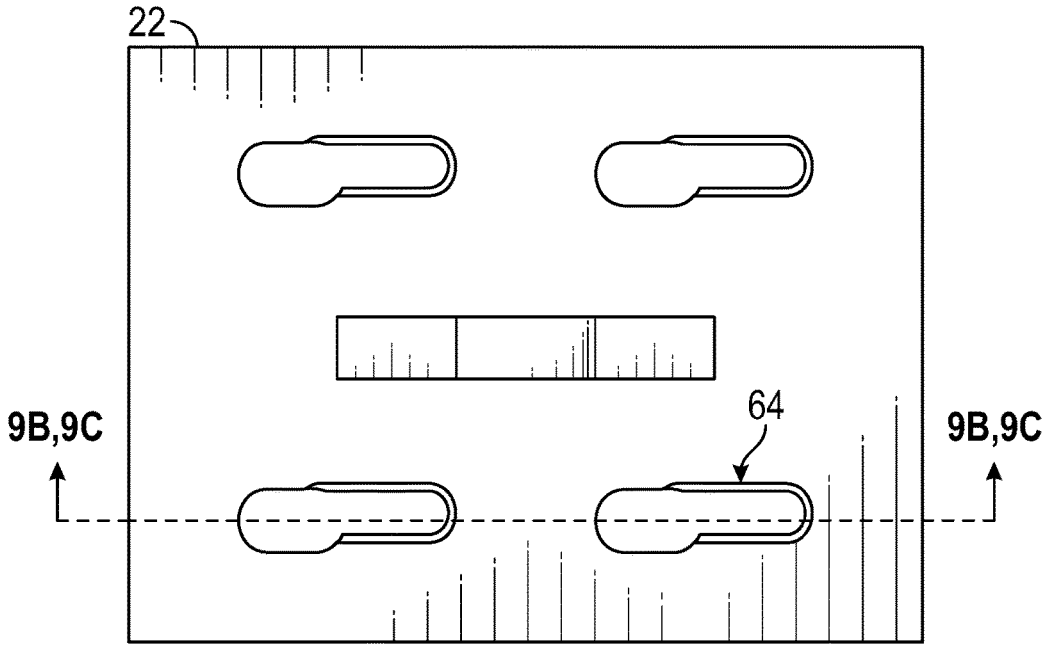
FIG. 9A is a top plan view of a plate in accordance with one embodiment of the present invention.
Figure 9B:
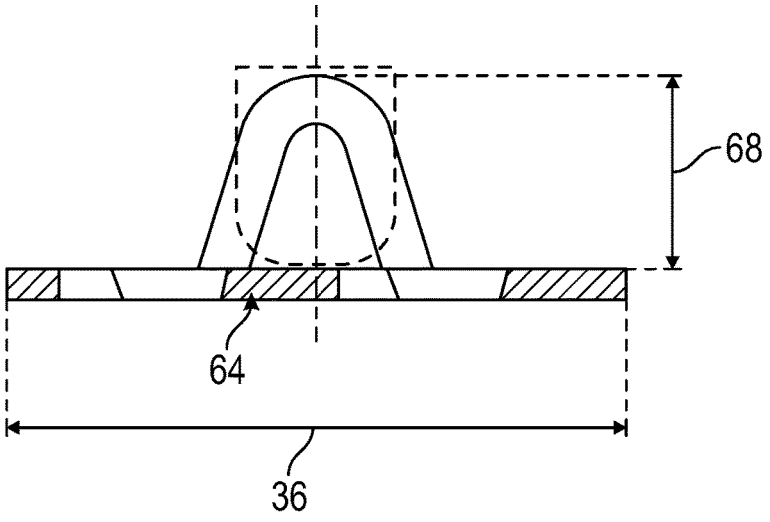
FIG. 9B is a cross-sectional view of the plate in FIG. 9A taken along line B-B in accordance with one embodiment of the present invention.
Figure 9C:
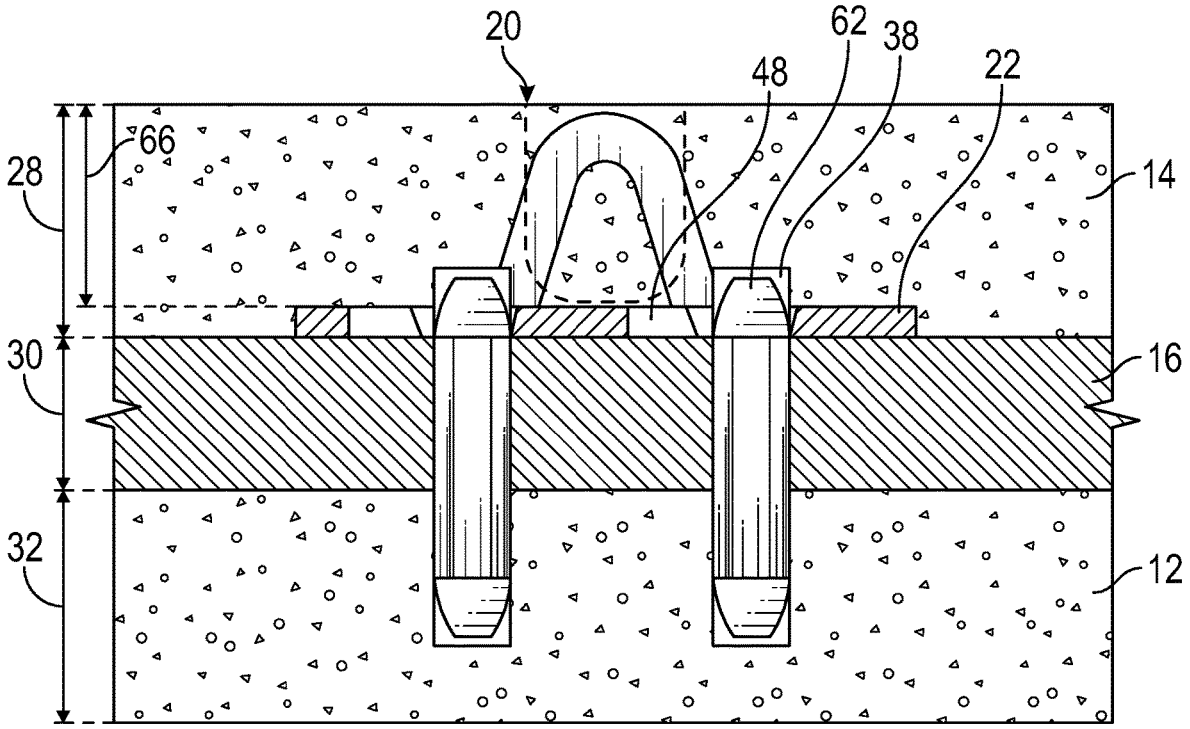
FIG. 9C is a cross-sectional view of the plate in FIG. 9A taken along line C-C in accordance with one embodiment of the present invention.

FIGS. 9A-9C also show various views of the aperture 48 and the slot 62 of the plate 22. Lines B-B and C-C are shown in FIG. 9A, and FIGS. 9B and 9C are cross-sectional views of the plate 22 taken along lines B-B and C-C, respectively, in FIG. 9A. FIG. 9B shows a plate length 36, and dimensions of the plate length 36 are described in further detail elsewhere herein. FIG. 9C shows the plate 22 selectively secured onto the pins 38. The plate 22 is first positioned over the pins 38 so that the exposed ends of the pins 38 extend through the apertures 48 in the plate 22. Then, the plate 22 moves laterally to a second position so that the pins 38 are positioned in slots 62 of the plate 22. Since the slots 62 have small widths, the slots 62 secure onto the recesses of the pins 38.

FIGS. 10A-10E show various views of the plate 22 and related dimensions. The plate 22 has four aperture 48 and slot 62 combinations. In some embodiments, a first slot horizontal offset 70 from the left edge of the plate 22 to the center of the slot 62 can be between approximately 25 mm and 40 mm. In various embodiments, the first slot horizontal offset 70 is approximately 32 mm. Next, in some embodiments, a slot-to-slot offset 72 from the centers of two slots 62 can be between approximately 80 mm and 95 mm. In various embodiments, the slot-to-slot offset 72 is approximately 88 mm. In some embodiments, a second slot horizontal offset 74 from a center of a second slot to the right edge of the plate 22 can be between approximately 25 mm and 40 mm. In various embodiments, the second slot horizontal offset 74 is approximately 32 mm. A plate length 76 can be between approximately 190 mm to 215 mm in some embodiments. In various embodiments, the plate length 76 is approximately 203 mm.

Along the bottom edge of the plate 22, a first aperture horizontal offset 78 from the right edge of the plate 22 to the center of an aperture can be between approximately 25 mm to 35 mm in some embodiments. In various embodiments, the first aperture horizontal offset 78 is approximately 30 mm. An aperture-to-aperture horizontal offset 80 from the centers of two apertures can be between approximately 80 mm to 95 mm in some embodiments. In various embodiments, the aperture-to-aperture offset 80 is approximately 88 mm. A second aperture horizontal offset 82 from the left edge of the plate 22 to the center of an aperture can be between approximately 30 mm to 40 mm in some embodiments. In various embodiments, the second aperture horizontal offset 82 is approximately 34 mm. A plate width 84 can be between approximately 140 mm to 160 mm in some embodiments. In various embodiments, the plate width 84 is approximately 152 mm.

Next, a first slot/aperture vertical offset 86 between the bottom edge of the plate 22 and a bottom edge of an aperture can be between approximately 15 mm and 25 mm in some embodiments. In various embodiments, the first slot/aperture vertical offset 86 is approximately 18 mm. First and second slot/aperture lengths 88, 92 can be between approximately 50 mm to 60 mm in some embodiments. In various embodiments, the first and second slot/aperture lengths 88, 92 are each approximately 55 mm. A slot/aperture-to-slot/aperture offset 90 between a top edge of a slot and a bottom edge of an aperture can be between approximately 30 mm and 40 mm in some embodiments. In various embodiments, the slot/aperture-to-slot/aperture offset 90 is approximately 36 mm. Finally, a second slot/aperture vertical offset 94 between the top edge of a slot and the top edge of the plate 22 can be between approximately 35 mm and 45 mm in some embodiments. In various embodiments, the second slot/aperture vertical offset 94 is approximately 39 mm. Also shown in FIG. 10A are lines B-B, C-C, and D-D.

Figure 10A:
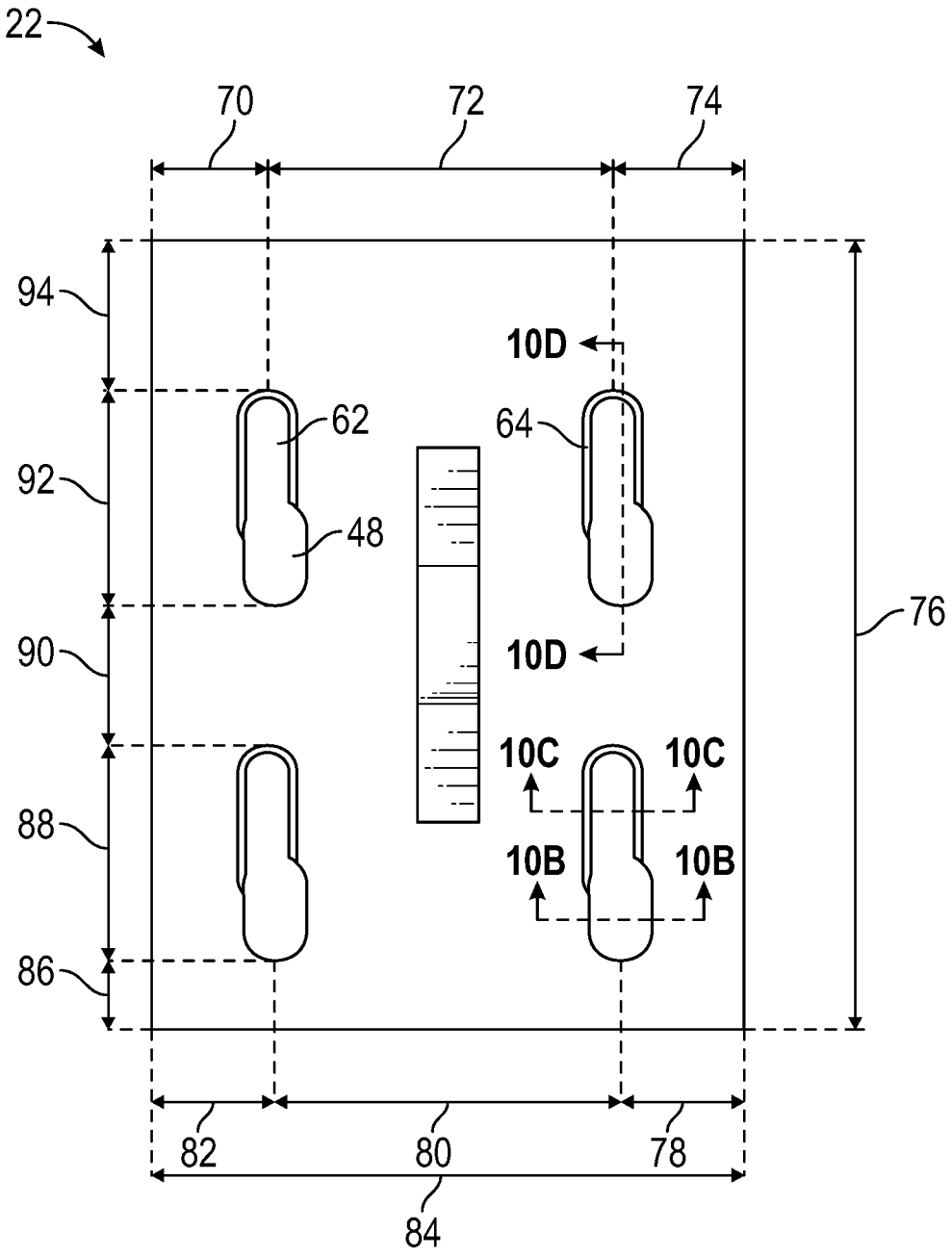
FIG. 10A is a top plan view of a plate in accordance with one embodiment of the present invention.
Figure 10B:
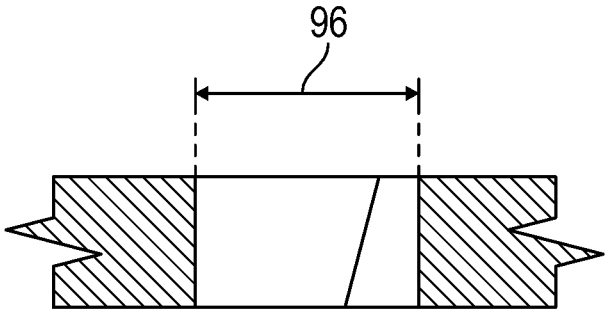
FIG. 10B is a cross-sectional view of the plate in FIG. 10A taken along line B-B in accordance with one embodiment of the present invention.

Now referring to FIG. 10B, a cross-sectional view of the plate 22 in FIG. 10A taken along line B-B is provided. This cross-sectional view shows the aperture and an aperture width 96. In some embodiments, the aperture width 96 can be between approximately 10 mm and 25 mm. In various embodiments, the aperture width 96 is a approximately 16 mm.

Figure 10C:
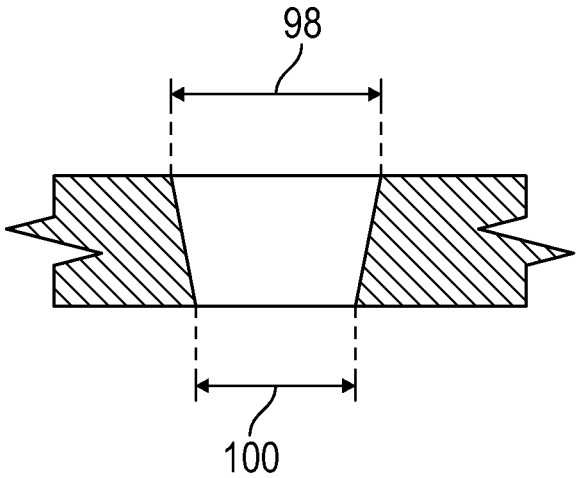
FIG. 10C is a cross-sectional view of the plate in FIG. 10A taken along line C-C in accordance with one embodiment of the present invention.

Now referring to FIG. 10C, a cross-sectional view of the plate 22 in FIG. 10A taken along line C-C is provided. This cross-sectional view shows the slot and a top slot width 98 and a bottom slot width 100. In some embodiments, the top slot width 98 can be between approximately 10 mm and 20 mm. In various embodiments, the top slot width 98 is approximately 15 mm. In some embodiments, the bottom slot width 100 can be between approximately 5 mm and 15 mm. In various embodiments, the bottom slot width 100 is approximately 11 mm. The bottom slot width 100 is smaller than the aperture width 96 in various embodiments.

Figure 10D:
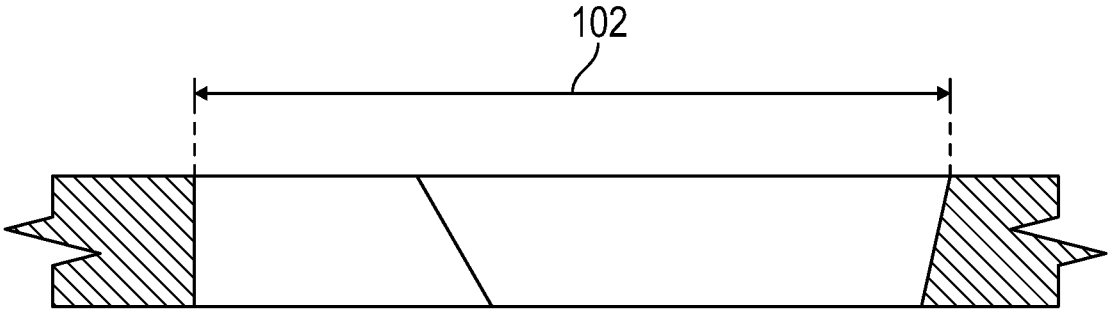
FIG. 10D is a cross-sectional view of the plate in FIG. 10A taken along line D-D in accordance with one embodiment of the present invention.

Now referring to FIG. 10D, a cross-sectional view of the plate 22 in FIG. 10A taken along line D-D is provided. This cross-sectional view shows a combined slot/aperture length 102, which can be between approximately 50 mm to 60 mm in some embodiments. In various embodiments, the slot/aperture length 102 is approximately 55 mm.

Figure 10E:
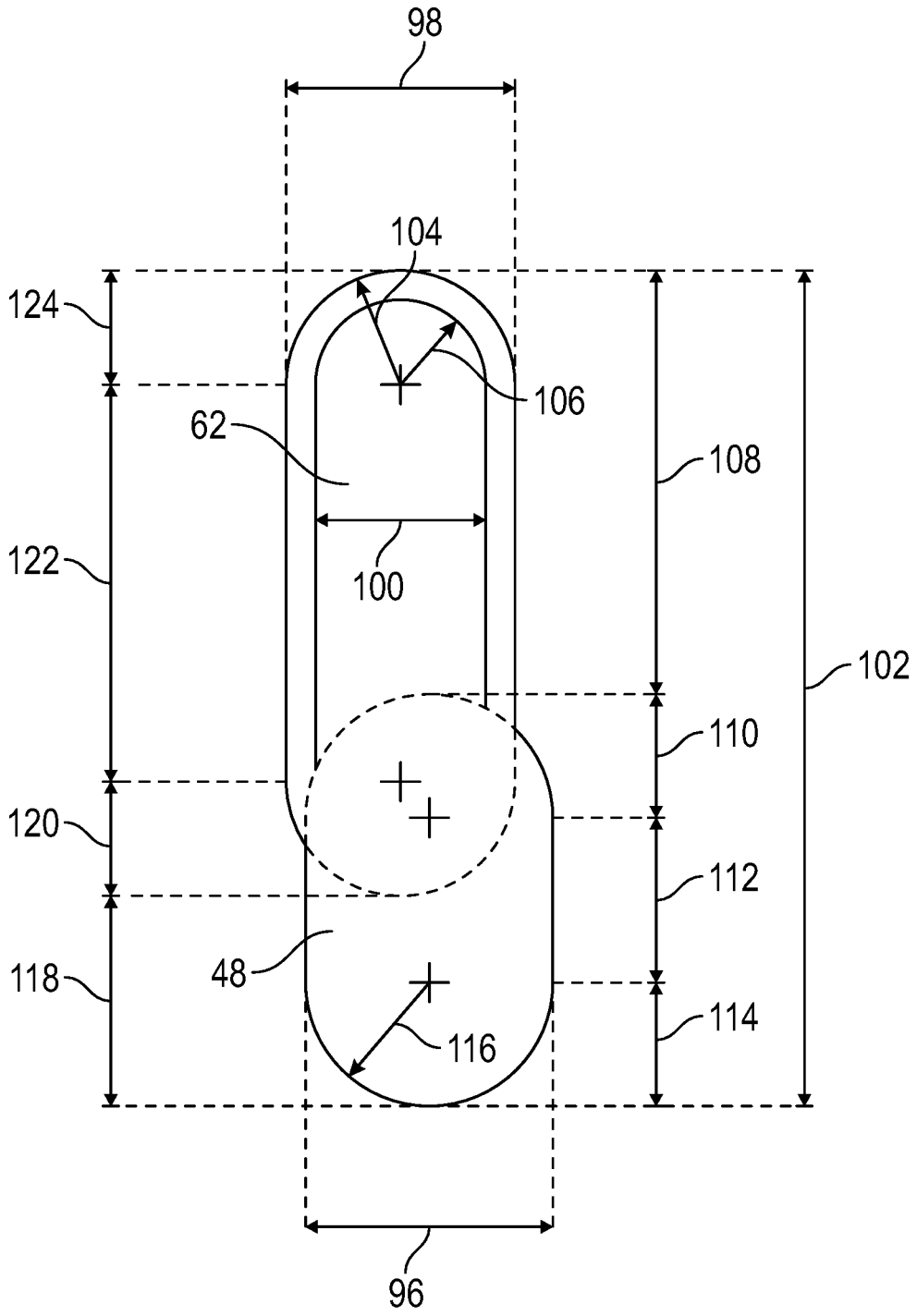
FIG. 10E is a top plan view of an aperture and a slot of a plate in accordance with one embodiment of the present invention.

Now referring to FIG. 10E, a top plan view of the aperture 48 and the slot 62 are provided. The aperture width 96, the top slot width 98, the bottom slot width 100, and the slot/aperture length 102 are described above. A first slot radius 104 taken at the top surface of the plate 22 can be between approximately 7 mm to 8 mm in some embodiments. In various embodiments, the first slot radius 104 is approximately 7.5 mm. A second slot radius 106 taken at the bottom surface of the plate 22 can be between approximately 5 mm and 6 mm in some embodiments. In various embodiments, the second slot radius 106 is approximately 5.5 mm.

A first length 108 from the top edge of the slot 62 to a top edge of the aperture 48 can be between approximately 20 mm to 35 mm in some embodiments. In various embodiments, the first length 108 is approximately 28 mm. A second length 110 from the top edge of the aperture 48 to a first center of curvature of the aperture 48 can be between approximately 5 mm and 10 mm in some embodiments. In various embodiments, the second length 110 is approximately 8 mm. A third length 112 from the first center of curvature of the aperture 48 to a second center of curvature can be between approximately 8 mm to 15 mm in some embodiments. In various embodiments, the third length 112 is approximately 11 mm. A fourth length 114 from the second center of curvature of the aperture 48 to a bottom edge of the aperture 48 can be between approximately 5 mm and 10 mm in some embodiments. In various embodiments, the fourth length 114 is approximately 8 mm.

An aperture radius 116 of the slot 62 can be between approximately 7 mm to 9 mm in some embodiments. In various embodiments, the aperture radius 116 is approximately 8 mm. A fifth length 118 from the bottom edge of the aperture 48 to a bottom edge of the slot 62 can be between approximately 10 mm to 20 mm in some embodiments. In various embodiments, the fifth length 118 is approximately 14 mm. A sixth length 120 from the bottom edge of the slot 62 to the first center of curvature of the slot 62 can be between approximately 6 mm to 9 mm in some embodiments. In various embodiments, the sixth length 120 is approximately 7.5 mm. A seventh length 122 from the first center of curvature of the slot 62 to a second center of curvature can be between approximately 20 mm to 35 mm in some embodiments. In various embodiments, the seventh length 122 is approximately 26 mm. An eighth length 124 from the second center of curvature of the slot 62 to the top edge of the slot 62 can be between approximately 6 mm to 9 mm in some embodiments. In various embodiments, the eighth length 124 is approximately 7.5 mm.

To provide additional background, context, and to further satisfy the written description requirements of 35 U.S.C. § 112, the following references are incorporated by reference herein in their entireties: U.S. Pat. Nos. 6,230,465; 6,701,683; 6,729,090; U.S. Publication No. 2006/0218870; U.S. Publication No. 2007/0144093; U.S. Publication No. 2008/0104913; and U.S. Publication No. 2008/0276559.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. An apparatus for selectively securing a plate to a pin in a precast concrete panel, comprising:

a plate having a substantially planar shape with an aperture having an aperture width;

a slot extending through said plate, said slot having a slot width that is smaller than said aperture width, wherein said slot and said aperture combine to form a continuous opening, and said slot tapers from a top width at a top surface of said plate to said slot width at a bottom surface of said plate;

a pin having a pin width that is greater than said slot width, wherein a recess in said pin defines a recess width that is smaller than said slot width;

wherein, in a first position, said pin is adapted to pass through said aperture in said plate in a longitudinal direction; and wherein, in a second position, said pin is adapted to move into said slot in said plate in a lateral direction such that said recess of said pin is at least partially positioned in said slot of said plate, and a inner surface of said plate that defines said slot and a surface of said pin that defines said recess engage each other to secure said plate to said pin and distribute a force from said plate to said pin.

2. The apparatus of claim 1, further comprising a lift anchor extending from a top surface of said plate.

3. The apparatus of claim 1, further comprising a plug adapted for positioning in said aperture to secure said pin in said slot of said plate.

4. The apparatus of claim 1, further comprising a collar positioned about said pin, wherein said collar has an outer dimension greater than said aperture width, and said collar allows said pin to pass through said aperture in said plate to a predetermined distance in said first position.

5. The apparatus of claim 4, wherein an alignment projection extends from said collar to align said pin in a predetermined direction relative to said plate.

6. The apparatus of claim 1, wherein said recess tapers from said pin width at an upper end of said recess to said recess width at a lower end of said recess.

7. The apparatus of claim 1, wherein said recess and said slot uniformly taper at complementary angles.

8. The apparatus of claim 1, wherein said recess extends into a side surface of said pin proximate to one end of said pin, and a second recess extends into said side surface at an opposing end of said pin.

9. The apparatus of claim 1, further comprising:

a second opening, a third opening, and a fourth opening through said plate; and an anchor extending from a top surface of said plate, wherein said anchor is positioned between said openings.

10. The apparatus of claim 9, wherein said openings are oriented in a common direction such that pins are adapted to move in said openings in said lateral direction to secure said plate to said pins and distribute said force from said plate to said pin.

11. The apparatus of claim 1 wherein said pin has a thermal conductivity of less than 15 W/m~K.

12. The apparatus of claim 1, wherein said slot width and said pin width extend from a common surface of said continuous opening.

13. The apparatus of claim 1, wherein said recess extends into said pin on only one side surface of said pin.

14. The apparatus of claim 1, wherein a shoulder surface of said pin partially defines said recess, and said shoulder surface is configured to contact a bottom surface of said plate in said second position.

15. An apparatus for selectively securing a plate to a pin in a precast concrete panel, comprising:

a plate having a substantially planar shape with an aperture having an aperture width;

a slot extending through said plate, said slot having a slot width that is smaller than said aperture width, wherein said slot and said aperture combine to form a continuous opening;

a pin having a pin width that is greater than said slot width, wherein a recess in said pin defines a recess width that is smaller than said slot width;

wherein, in a first position, said pin is adapted to pass through said aperture in said plate in a longitudinal direction;

wherein, in a second position, said pin is adapted to move into said slot in said plate in a lateral direction such that said recess of said pin is at least partially positioned in said slot of said plate to secure said plate to said pin and distribute a force from said plate to said pin; and a plug adapted for positioning in said aperture to secure said pin in said slot of said plate.

16. An apparatus for selectively securing a plate to a pin in a precast concrete panel, comprising:

a plate having a substantially planar shape with an aperture having an aperture width;

a slot extending through said plate, said slot having a slot width that is smaller than said aperture width, wherein said slot and said aperture combine to form a continuous opening;

a pin having a pin width that is greater than said slot width, wherein a recess in said pin defines a recess width that is smaller than said slot width;

wherein, in a first position, said pin is adapted to pass through said aperture in said plate in a longitudinal direction;

wherein, in a second position, said pin is adapted to move into said slot in said plate in a lateral direction such that said recess of said pin is at least partially positioned in said slot of said plate to secure said plate to said pin and distribute a force from said plate to said pin; and a collar positioned about said pin, wherein said collar has an outer dimension greater than said aperture width, and said collar allows said pin to pass through said aperture in said plate to a predetermined distance in said first position.

* * * * *